US005860046A

United States Patent [19]

Ikegawa et al.

[11] Patent Number: 5,860,046

[45] Date of Patent: Jan. 12, 1999

[54] CHARGING METHOD AND CHARGING DEVICE

[75] Inventors: Akihito Ikegawa, Sakai; Keiko Momotani, Suita; Isao Doi, Toyonaka, all of Japan

[73] Assignee: Minolta Co., Ltd., Osaka, Japan

[21] Appl. No.: 889,822

[22] Filed: Jul. 8, 1997

[30] Foreign Application Priority Data

Jul. 9, 1996 [JP] Japan ..... 8-179237
Jul. 9, 1996 [JP] Japan ..... 8-179248

[51] Int. Cl.[6] ..... G03G 15/02

[52] U.S. Cl. ..... 399/174; 361/225; 430/902

[58] Field of Search ..... 399/174, 175, 399/176; 361/225; 430/902

[56] References Cited

U.S. PATENT DOCUMENTS 5,357,322 10/1994 Hoshika ..... 399/174
5,402,213 3/1995 Ikegawa et al. ..... 399/174
5,504,561 4/1996 Ikegawa et al. ..... 399/174

FOREIGN PATENT DOCUMENTS 0 515 164 11/1992 European Pat. Off. .
3-24586 2/1991 Japan .
5-107866 4/1993 Japan .
5-107873 4/1993 Japan .

*Primary Examiner*—Joan H. Pendegrass
*Attorney, Agent, or Firm*—McDermott, Will & Emery

[57] ABSTRACT

The present invention provides a contact charging device, in which a contact member for charging is in contact with a charge receiving member for charging the same while suppressing charging irregularity. The contact member has a surface to be in contact with the charge receiving member. This surface has a volume resistivity in a range from $1\times10^4$ Ω·cm to $1\times10^{10}$ Ω·cm, and has a surface resistivity in a range from $1\times10^5$ Ω/□ to $1\times10^{10}$ Ω/□.

Alternatively, the contact member has a surface to be in contact with the charge receiving member. This surface of the contact member has a surface hardness which provides a scratch width of 1 μm or less under scratch hardness test.

17 Claims, 4 Drawing Sheets

CHARGING METHOD AND CHARGING DEVICE

BACKGROUND OF THE INVENTION

1. Field of the Invention

The present invention relates to a charging method and a charging device for charging a charge receiving member. In particular, the invention relates to a charging method and a charging device for charging a charge receiving member through a portion in contact with the charge receiving member. More specifically, the invention relates to a charging method and a charging device having a member to be in contact with an electrostatic latent image carrier such as a photosensitive member in an image forming apparatus for charging the electrostatic latent image carrier to a predetermined potential.

2. Description of the Related Art

In electrophotographic image forming apparatuses such as a copying machine and a printer, a charging device charges an electrostatic latent image carrier such as a photosensitive drum, image exposure is effected on a charged area to form an electrostatic latent image, the electrostatic latent image is developed into a visible image, and this visible image is transferred and fixed onto a transfer member. A charging device is employed for charging the surface of the electrostatic latent image carrier prior to formation of the latent image. The apparatus also employs other charging devices such as a transfer charger for transferring the visible image formed on the electrostatic latent image carrier onto a transfer member and a separating charger for separating the transfer member bearing the transferred visible image from the electrostatic latent image carrier.

As the charging devices, corona charging devices such as a Corotron charging device or a Scorotron charging device utilizing corona discharging have been used. Although the corona charging device can advantageously perform stable charging, it requires a high voltage and produces a large amount of ozone. In recent years, therefore, contact charging devices which can replace the corona charging devices have been proposed.

The contact charging device has a charging member which is subjected to a voltage and is brought into contact with a charge receiving member. The charge receiving member is charged by discharge occurring at a gap between a region, which is continuous to a contact region of the charging member with the charge receiving member and is spaced from the charge receiving member, and the surface of the charge receiving member.

These contact charging devices have such an advantage that they produce a particularly smaller amount of ozone than the corona charging device. Also, the contact charging device can operate with a voltage lower than that required by the corona charging device.

The charging member may take various forms such as a charging roller and a charging brush, and other forms such as a sheet-like charging member made of a film have been proposed. In particular, the sheet-like charging member is advantageous in view of reduction in size and cost of the charging device.

However, the contact charging device, and particularly the charging device employing the sheet-like charging member may suffer from the following problem.

The surface of the charge receiving member may be irregularly charged into a scale-like form (scaly form). Therefore, if the charge receiving member is an electrostatic latent image carrier and a mesh image of 1-dot/4-dots is formed as shown in FIG. 5, irregularity in image density occurs in the mesh image due to lack and/or drop of dots forming mesh points. This results in scale-like noises as shown in FIG. 6. This means that the surface of the charge receiving member was not uniformly charged, and charging irregularity occurred in a scale-like form.

Charging of the charge receiving member is primarily performed by discharging occurring at the gap between the region, which is continuous to the contact region of the charging member with the charge receiving member and is spaced from the charge receiving member, and the surface of the charge receiving member. However, charging is also performed by injection charging and specifically by injection of charges from the charging member at an area through which the charging member is in contact with the charge receiving member. This injection charging is strongly affected by a surface resistance of the charging member, and the surface resistance is strongly affected by environmental variation (temperature and humidity). Therefore, the charged potential of the charge receiving member varies with environmental variation as a whole. This prevents stable formation of good images.

Further, a pin-hole may be formed at the surface of the charge receiving member, in which case damages such as scorch and burn may occur at the charging member.

For example, when the contact charging device charges the photosensitive member, foreign matters such as shaved powder of the photosensitive member, residual toner and paper powder gradually stick locally to the surface of the charging member opposed to the photosensitive member as the printing and therefore image formation are repeated and the charging device is operated for a longer term. Abnormal discharging occurs at the portion bearing the foreign matters thus accumulated, so that the surface portion of the photosensitive member opposed to this portion bearing the foreign matters is abnormally charged in a brush-stroke-like form, so that brush-stroke-like noises occur at the image. FIG. 7 shows an example of an image (mesh image) bearing the brush-stroke-like noises.

SUMMARY OF THE INVENTION

An object of the invention is to provide a contact charging method and a contact charging device, in which a charge receiving member can be charged while suppressing charging irregularity.

Another object of the invention is to provide a contact charging method and a contact charging device, which can suppress variation in charged potential of a charge receiving member due to environmental variation.

Still another object of the invention is to provide a contact charging method and a contact charging device, which can suppress damages of a charging member such as scorch and burn due to a scratch such as a pin-hole at a surface of a charge receiving member.

Yet another object of the invention is to provide a contact charging method and a contact charging device, which can suppress sticking and deposition of contaminants at a surface of a charging member, and thereby can suppress occurrence of charging irregularity in a brush-stroke-like form to a practically acceptable extent.

Further another object of the invention is to provide a contact charging method and a contact charging device, which can stably perform good charging for a long term with a high reliability.

For achieving the above object, the invention provides a method for charging a charge receiving member comprising the steps of:

providing a contact member having a surface, said surface having a volume resistivity in a range from $1\times10^4$ Ω·cm to $1\times10^{10}$ Ω·cm, and having a surface resistivity in a range from $1\times10^5$ Ω/□ to $1\times10^{10}$ Ω/□;

contacting the surface of said contact member with the charge receiving member; and applying an electrical power to said contact member.

For achieving the above object, the invention also provides a charging device for charging a charge receiving member comprising:

an electrical power source for supplying an electrical power; and a contact member which is electrically connected with said electrical power source, said contact member having a surface for contacting with the charge receiving member, wherein said surface has a volume resistivity in a range from $1\times10^4$ Ω·cm to $1\times10^{10}$ Ω·cm, and has a surface resistivity in a range from $1\times10^5$ Ω/□ to $1\times10^{10}$ Ω/□.

For achieving the above object, the invention further provides a method for charging a charge receiving member comprising the steps of:

providing a contact member having a surface, the width of scratch of said surface under the scratch hardness test being 1 μm or less;

contacting said surface of the contact member with the charge receiving member; and applying an electrical power to said contact member.

For achieving the above object, the invention further provides a charging device for charging a charge receiving member comprising:

an electrical power source for supplying an electrical power; and a contact member which is electrically connected with said electrical power source, said contact member having a surface for contacting with the charge receiving member, wherein the width of scratch of said contact member under the scratch hardness test is 1 μm or less.

The latter charging method and device have been developed based on the following consideration. Foreign matters are accumulated on the contact member for charging principally due to the following fact. As the charging device is operated repetitively, minute irregular (convex and concave) portions are formed at a surface of the contact member opposed to the charge receiving member due to sliding and others with respect to the charge receiving member, and foreign matters fill the irregular portions and remains there. By setting the hardness of the surface in a specific range, charging irregularity in a brush-stroke-like form can be suppressed to a practically acceptable extent.

The scratch hard test is performed in the following manner. This test uses a conical diamond contact needle, which has an apical radius of 5 μm and an apical angle of 90 degrees. The tip end of this needle is brought perpendicularly into contact with a flat surface of a work (the contact member). With a load of 0.4 g, the needle is moved on the work at a speed of 0.3 mm/second. A width of the scratch caused by this movement is measured.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
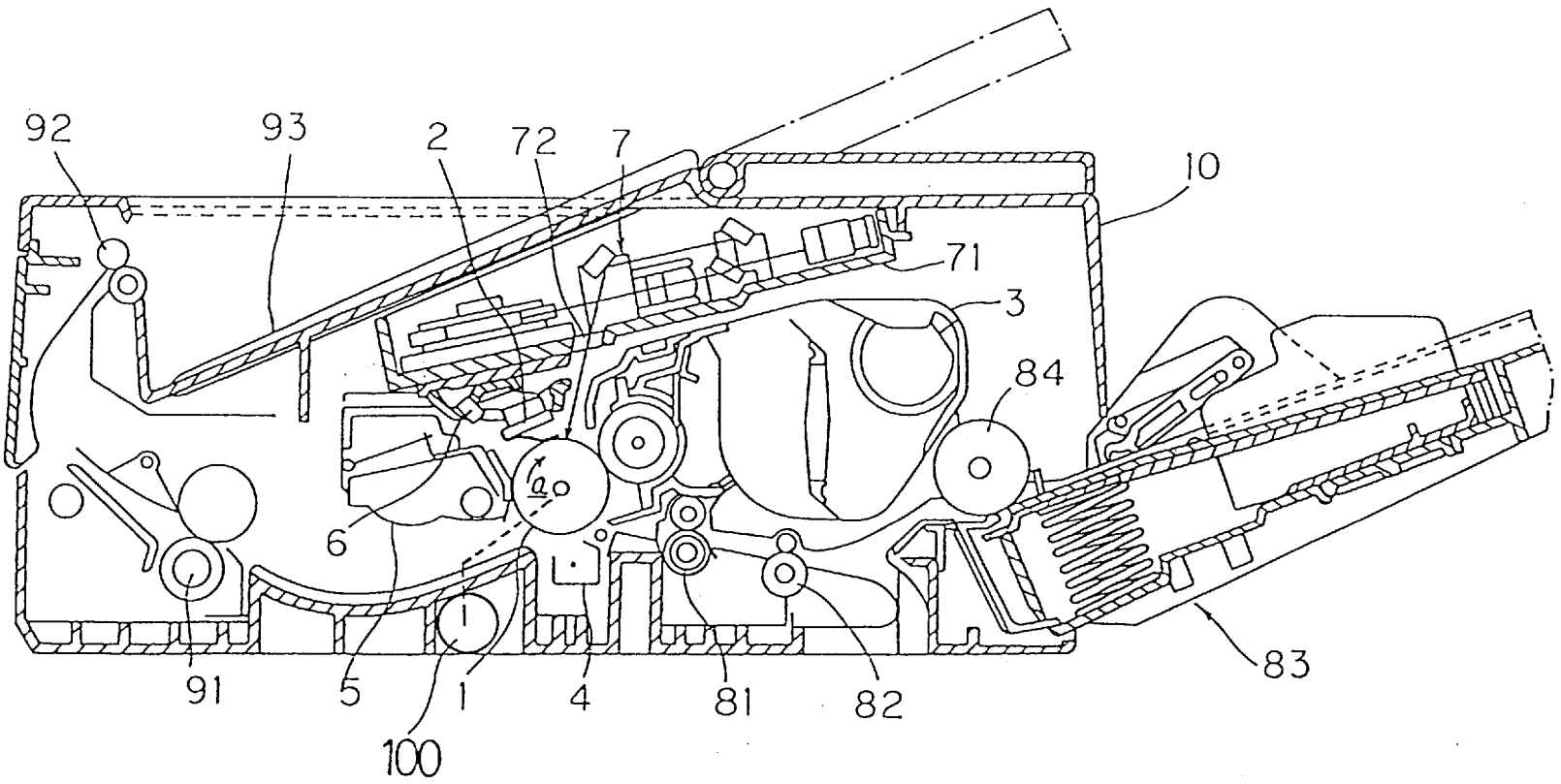
FIG. 1 shows a schematic structure of an example (printer) of an image forming apparatus equipped with a contact charging device according to the invention.

A contact charging device of an embodiment of the invention includes a contact member which is electrically connected with an electric power source and has a surface to be in contact with a charge receiving member.

This contact member has a volume resistivity in a range from $1\times10^4$ Ω·cm to $1\times10^{10}$ Ω·cm and more preferably in a range from $1\times10^4$ Ω·cm to $1\times10^6$ Ω·cm, and has a surface resistivity in a range from $1\times10^5$ Ω/□ to $1\times10^{10}$ Ω/□.

In the case where the volume resistivity of the contact member for charging is in a range from $1\times10^4$ Ω·cm to $1\times10^{10}$ Ω·cm but the surface resistivity is smaller than $1\times10^5$ Ω/□, the charged surface potential of the charge receiving member varies to a large extent with variation in environmental factors, and practically unignorable damages such as scorch and burn of the contact member may occur due to scratches such as a pin-hole at the charge receiving member. Also, uniformity in discharging is impaired, so that charging irregularity may occur in a scale-like form (scaly form). In the case where the surface resistivity is in a range from $1\times10^5$ Ω/□ to $1\times10$ Ω/□, uniformity in discharging is achieved, variation in charged surface potential of the charge receiving member due to environmental variation is suppressed, and it is possible to suppress practically unignorable damages such as scorch and burn of the contact member due to scratches such as a pin-hole at the charge receiving member. The reason for this can be considered as follows. Surface charges (i.e., charges on the surface of the contact member) do not move to a large extent at a portion of the contact member upstream to a portion in contact with the charge receiving member, and concentrated discharging is suppressed. Therefore, uniform discharging state is maintained. Also, injection charging is performed only to a small extent due to increase in contact resistance with the charge receiving member. Therefore, variation in charged surface potential of the charge receiving member due to environmental variation is suppressed, and it is possible to suppress practically unignorable damages such as scorch and burn of the contact member due to scratches such as a pin-hole at the charge receiving member. However, the surface resistivity larger than $1\times10^{10}$ Ω/□ impairs the discharging uniformity due to the excessively large surface resistivity.

In the case where the surface resistivity is in a range from $1\times10^5$ Ω/□ to $1\times10^{10}$ Ω/□ but the volume resistivity is smaller than $1\times10^4$ Ω·cm, the following problems (1) and (2) arise.

(1) Practically unignorable damages such as scorch and burn of the contact member occur due to scratches such as a pin-hole at the charge receiving member.

(2) Irregular discharging in a scale-like form occurs. This is probably due to the fact that lateral flow of electric charges are likely to occur at the inside of the surface of the contact member.

The volume resistivity larger than $1\times10^{10}$ Ω·cm causes lowering in potential, which results in lowering of a voltage applied across the contact member and the charge receiving member, so that discharging is not performed sufficiently and the charge receiving member cannot be charged uniformly.

According to the charging device, the contact member is electrically connected with said electrical power source and is supplied with a voltage such as a DC voltage from the power source. The charge receiving member is charged by relative movement between the contact member and the charge receiving member. The contact member has the volume resistivity in the restricted range from $1\times10^{4}$ Ω·cm to $1\times10^{10}$ Ω·cm, and also has the surface resistivity in the restricted range from $1\times10^{5}$ Ω/□ to $1\times10^{10}$ Ω/□. Therefore, irregular charging in a scale-like form of the charge receiving member is sufficiently suppressed. Also, variation in charged surface potential of the charge receiving member due to environmental variation is suppressed. Further, it is possible to suppress practically unignorable damages such as scorch and burn of the contact member due to scratches such as a pin-hole at the charge receiving member. Long-term use is also allowed.

The contact member may be typically a sheet-like member, which is advantageous in view of reduction in size and cost of the device.

The sheet-like member may be supported in a cantilever manner. In this case, the contact member is generally arranged to be partially in contact with the charge receiving member.

Figure 3:
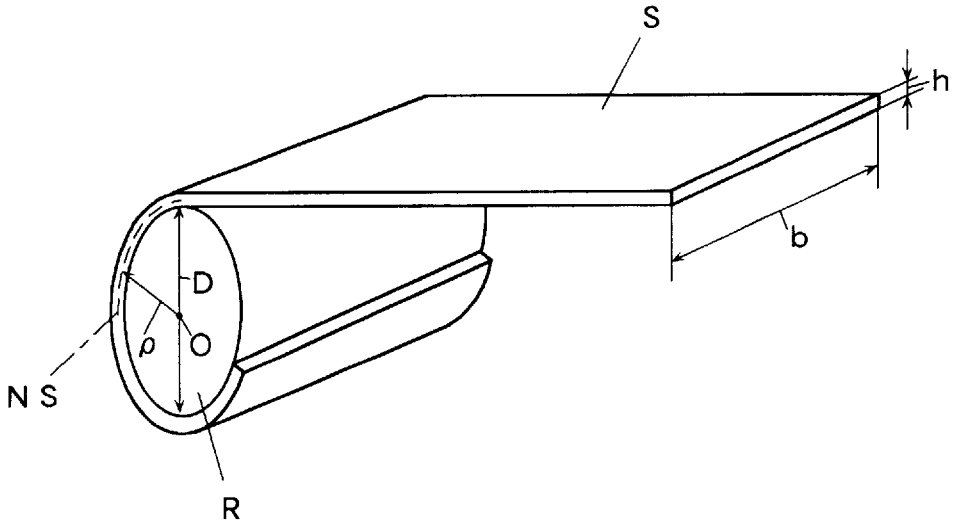
FIG. 3 shows a film material forming a film charging member.

The sheet-like member may have a flexibility and, for example, may be a flexible film charging member, in which case a bending moment required for bending the same may be smaller than about 20 g·cm and more preferably about 10 g·cm as will be described later with reference to FIG. 3. Naturally, it must have mechanical strengths against breakage, tear and others required for the charging contact member.

In any case, the contact member may be made of organic material (e.g., polyamide resin) containing electrically conductive carbon powder dispersed therein.

In connection with the structure, the contact member may have a two-layer structure including two layers, each of which is made of, for example, organic material (e.g., polyamide resin) containing electrically conductive carbon powder dispersed therein.

A contact charging device of another embodiment of the invention likewise includes a contact member which is electrically connected with an electric power source and has a surface to be in contact with a charge receiving member.

In this device, the contact member has such a surface hardness that the width of scratch of said surface under the scratch hardness test is 1 μm or less. This test uses a conical diamond contact needle, which has an apical radius of 5 μm and an apical angle of 90 degrees. The tip end of this needle is brought perpendicularly into contact with a flat surface of the film charging member. With a load of 0.4 g, the needle is moved on the surface of the member at a speed of 0.3 mm/second. The width of the scratch produced thereby is measured.

If the contact member for charging has the surface hardness which produces the scratch of 1 μm or less in width at the surface of the contact member under the specific conditions, the charging irregularity in a brush-stroke-like form can be suppressed to a practically acceptable extent.

According to the charging device which is operated in accordance with the method of the invention, the contact member is in contact with the charge receiving member, and is supplied with a voltage such as a DC voltage. The charge receiving member is charged by relative movement between the contact member and the charge receiving member. Therefore, minute irregular portions are suppressed from being formed at the surface opposed to the charge receiving member due to sliding and others with respect to the charge receiving member, and therefore it is possible to suppress local filling and accumulation of foreign matters, which may cause charging irregularity in a brush-stroke-like form. Thereby, charging irregularity in a brush-stroke-like form can be suppressed to a practically acceptable extent, and good charging can be stably performed for a long term.

Similarly to the foregoing charging device, the contact member may be typically a sheet-like member.

The sheet-like member may be supported in a cantilever manner.

The sheet-like member may have a flexibility and, for example, may be a flexible film charging member, in which case a bending moment required for bending the same may be smaller than about 20 g·cm and more preferably about 10 g·cm. Naturally, it must have mechanical strengths against breakage, tear and others required for the charging contact member.

In any case, the contact member may be made of polyimide resin.

The "charge receiving member" in either of the charging devices already described is typically an electrostatic latent image carrier such as a photosensitive member, but is not restricted thereto. The charging device of the invention can be applied to various charge receiving members which require prevention or suppression of charging irregularity.

Preferred embodiments of the invention will be further described below with reference to the drawings.

Each of charging devices which will be described later is mounted in a printer shown in FIG. 1.

Figure 2:
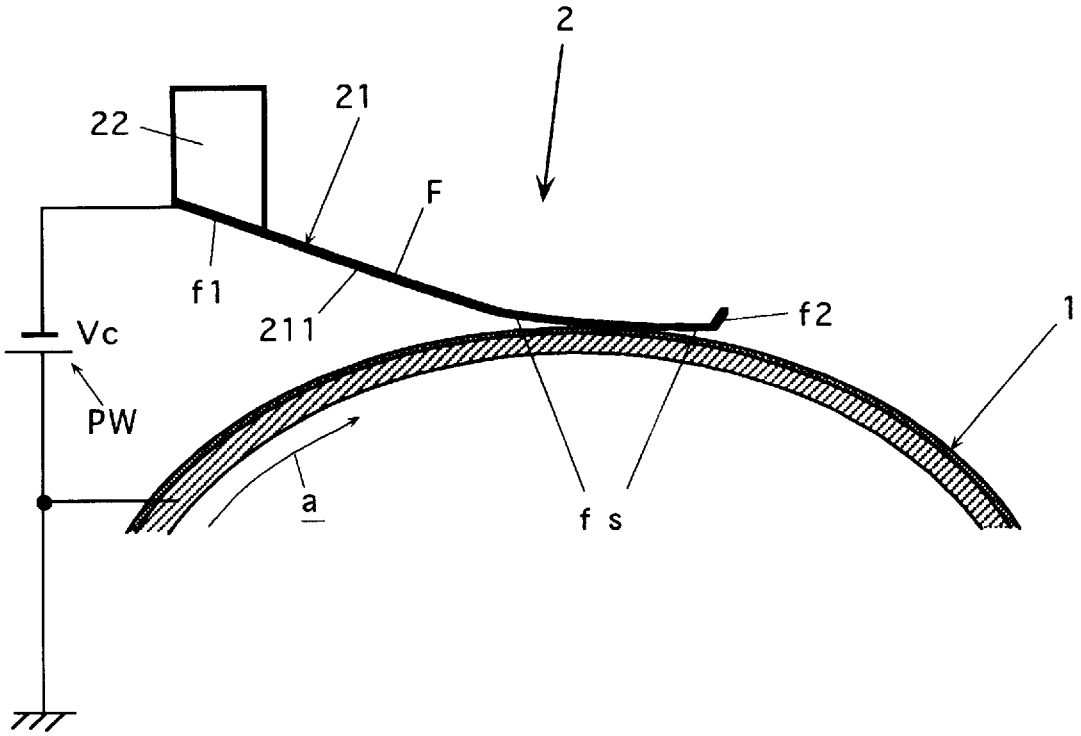
FIG. 2 is a side view showing a schematic structure of the contact charging device according to the invention.

The printer shown in FIG. 1 is provided at its center with a photosensitive drum 1 which is an electrostatic latent image carrier (charge receiving member). The drum 1 is driven to rotate in a direction of an arrow a by a main electric motor 100. A charging device 2, a developing device 3, a transfer charger 4, a cleaning device 5 and an eraser 6 are successively arranged around the drum 1. The charging device 2 is a contact charging device according to the invention, and has a charging member 21 for charging as shown in FIG. 2. For image formation, a DC voltage $V_C$ is applied from a power source PW. The charging device 2 will be described later.

An optical system 7 is arranged above the photosensitive drum 1. The optical system 7 includes a housing 71, which accommodates a semiconductor laser generating device, a polygonal mirror, a toroidal mirror, a half mirror, a spheric mirror, a return mirror, a reflection mirror and others. The housing 71 is provided at its floor with an exposure slit 72, through which image exposure is performed on the photosensitive drum 1 also through a space between the charging device 2 and the developing device 3.

A timing roller pair 81, an intermediate roller pair 82 and a sheet supply cassette 83 are successively arranged at the right of the photosensitive drum 1 in the figure. A sheet feed roller 84 is opposed to the sheet supply cassette 83. A fixing roller pair 91 and a sheet discharge roller pair 92 are successively arranged at the left of the photosensitive drum 1 in the figure. A sheet discharge tray 93 is opposed to the sheet discharge roller pair 92. The parts described above are arranged in a main printer unit 10.

According to this printer, the surface of the photosensitive drum 1 is charged by the charging device 2 to a predetermined potential, and the optical system 7 performs image exposure on the charged area to form an electrostatic latent image. The electrostatic latent image thus formed is developed by the developing device 3 into a toner image, which is moved to a transfer region opposed to the transfer charger 4.

The sheet feed roller 84 pulls the transfer sheet from the sheet feed cassette 83. The transfer sheet moves through the intermediate roller pair 82 to the timing roller pair 81, and then is fed to the transfer region in synchronization with the toner image on the drum 1. Owing to the operation of the transfer charger 4 at the transfer region, the toner image on the drum 1 is transferred onto the transfer sheet, which is moved to the fixing roller pair 91, and then is discharged to the sheet discharge tray 93 by the sheet discharge roller pair 92 after fixing of the toner image by the fixing roller pair 91.

After the toner image is transferred onto the transfer sheet, toner remaining on the photosensitive drum 1 is cleaned up by the cleaning device 5. An eraser 6 erases residual electric charges.

A system speed of the printer (i.e., peripheral speed of the photosensitive drum 1) is 3.5 cm/sec. The developing device 3 is a one-component contact developing device performing reversal development.

The photosensitive drum 1 is of a function-separated type for negative charging, and has a sensitivity to long-wave light. A charge generating layer is formed of mixture of τ-type non-metal phthalocyanine and polyvinyl butyral resin, and has a thickness of about 0.4 μm. A charge transporting layer is formed of mixture which principally contains hydrazone compound and polycarbonate resin, and has a thickness of about 18 μm. The electrostatic latent image carrier to which the charging device of the invention can be applied is not restricted to the above structure.

The toner used in the developing device 3 is of a negative type, and is formed of mixture principally containing bisphenol A polyester resin and carbon black. The mixture is kneaded, ground and classified by a known method to produce toner particles having a mean diameter of 10 μm.

The toner thus prepared is accommodated in the developing device 3, which performs developing with a developing bias $V_B$.

The contact charging device 2 will be further described. As shown in FIG. 2, the contact charging device 2 includes a film charging member 21 which is a sheet-like contact member for charging. The film charging member 21 has the following specific structure. A film F having predetermined sizes is supported at one end f1 by a supporting member 22 in a cantilever manner. A free end f2 of the film F is bent upward, and a surface 211 at and near the free end opposed to the photosensitive drum 1 is brought into contact with the surface of the photosensitive drum 1. A power source PW applies a DC voltage Vc of −1.2 kV to the charging member 21.

The film F forming the charging member 21 is a flexible film as disclosed in U.S. Pat. No. 5,192,974. More specifically, as shown in FIG. 3, the film F has a bending moment Mm of 20 g·cm or less and more preferably of 10 g·cm or less which is required for winding the film having a width b of 1 cm around a core rod R having an outer diameter D of 1 cm. It has a sufficient mechanical strength against breakage, tear and others required for the charging member. The bending moment Mm is $EI/\rho$ ($I=bh^3/12$). E represents a modulus of elasticity ($g/cm^2$) of the film F. I represents a second moment ($cm^4$) of the cross section. ρ represents a curvature radius (cm) equal to a distance between a center O of the core rod R and a neutral surface NS of the film F. h represents a thickness of the film.

The charging member 21 (film F) has a volume resistivity in a range from $1\times10^4$ Ω·cm to $1\times10^{10}$ Ω·cm, and has a surface resistivity ρs in a range from $1\times10^5$ Ω/□ to $1\times10^{10}$ Ω/□.

According to the contact charging device 2, the charging member 21 has the volume resistivity in a range from $1\times10^4$ Ω·cm to $1\times10^{10}$ Ω·cm, and has the charging contributing surface fs having the surface resistivity ρs in a range from $1\times10^5$ Ω/□ to $1\times10^{10}$ Ω/□. Therefore, irregular charging in a scale-like form of the photosensitive drum 1 is suppressed, and it is also possible to suppress variation in charged potential of the photosensitive drum 1 due to environmental variation. Further, it is possible to suppress damages such as scorch and burn of the contact member 21 due to scratches such as a pin-hole at the surface of the photosensitive drum 1. Accordingly, long-term use is also allowed.

Description will now be given on experimental examples 1-1 to 1-4 which prove that the charging device 2 can sufficiently suppress the scale-like charging irregularity and variation in charged potential due to environmental variation to a practically acceptable extent, and can also suppress scorch, burn or the like due to scratches such as a pin-hole at the surface of the photosensitive drum 1 owing to the fact that the charging member 21 has the aforementioned volume resistivity as well as the charge contributing surfaces fs having the aforementioned surface resistivity. These experimental examples 1-1 to 1-4 are shown in the following table 1 together with comparative experimental examples 1-1 to 1-5 which were performed for comparison.

All the experiments were performed with the printer already described. The voltage Vc applied to the charging member 21 was −1.2 kV, and the developing bias voltage $V_B$ was set to −700 v similar to the charging potential applied to the photosensitive drum 1 by the charging member 21. Images for evaluating charged states were prepared by printing white solid images for evaluating uniformity in charged potential. Toners and others used in the developing device were the same as those already described.

Films forming the charging members for experiments had the following two-layer structure. One layer was formed of a film having a thickness of 30 μm and made of polyamide resin and electrically conductive carbon powder dispersed therein, and having a volume resistivity of $3\times10^5$ Ω·cm. The other layer was a surface resistance layer which was made of polyamide resin and electrically conductive carbon powder dispersed therein, had a thickness of about 1 μm, and was opposed to the photosensitive drum 1. The surface resistance layers of the films used in the experiments had various rates of the carbon powder in the resin and various surface resistivities, respectively. Accordingly, the surface 211 in contact with the photosensitive drum 1 was the surface of the surface resistance layer. The film has the volume resistivity of about $3\times10^5$ Ω·cm as a whole. The surface resistance layer 211 was in contact with the photosensitive drum 1.

When the scale-like charging irregularity occurs, scale-like noises appear at the image for evaluating the charged state. Therefore, the charging performance was evaluated by observing the scale-like noises at the images. Variation in charged potential on the photosensitive drum 1 due to environmental variation was evaluated by determining a difference ΔV (width of surface potential variation) between the charged potential on the photosensitive drum 1 at a temperature of 10° C. and an RH of 5%, and at a temperature of 30° C. and an RH of 85%. An influence of scratches on the photosensitive drum was evaluated with the photosensitive drum 1 having a surface at which a pin-hole was formed.

Description will now be given on evaluation of the scale-like noises at the image based on the scale-like charging irregularity on the surface of the photosensitive drum 1, evaluation of variation in charged potential due to environmental variation and evaluation of an influence by a pin-hall. In the evaluation, a mark "O" represents an acceptable image. Marks "Δ" and "X" represent unacceptable images.

(Evaluation of Scale-Like Noises (uniformity in discharging))

The developing bias voltage $V_B$ of the developing device 3 of the printer was set to −700 v similar to the charged potential of the photosensitive drum 1 charged by the charging member 21. White solid images were prepared (no exposure was performed), and so-called bias developing was performed with the original potential charged by the charging member. Thereby, images for evaluating the charged state were prepared and printed on transfer sheets for evaluating the uniformity in charged potential. The image for evaluating the charged state would be formed of toner uniformly adhering to the whole transfer sheet, if a uniform charged state was attained. Conversely, an irregular charged state would result in an irregular image including a white blank at a high-charged portion and a black portion at a low-charged portion. The images for evaluating the charged state on the transfer sheets were visually observed, and were ranked as follows.

O: No scale-like noise was present. (No scale-like charging. Uniform charging)

Δ: Scale-like noises were partially present. (Scale-like charging irregularity was partially present.)

X: Scale-like noises were entirely present. (Scale-like charging irregularity was entirely present.)

(Evaluation of Variation in Charged Potential Due to Environmental Variation)

O: $\Delta V \leqq 30$ v

Δ: 30 v$<\Delta V \leqq 80$ v

X: 80 v$<\Delta V$ (Evaluation of Influence by Pin-Hole)

O: No scorch or no spreading of scorch occurred.

Δ: Scorch and spreading occurred.

X: Burn of film occurred.

TABLE 1

| | S/R (Ω/□) | U/D | S/Pt (V) | R/Pin |
|---|---|---|---|---|
| CE 1-1 | $1 \times 10^2$ | X | X | X |
| CE 1-2 | $3 \times 10^3$ | Δ | X | X |
| CE 1-3 | $1 \times 10^4$ | Δ | Δ | X |
| EX 1-1 | $3 \times 10^5$ | O | O | O |
| EX 1-2 | $2 \times 10^6$ | O | O | O |
| EX 1-3 | $6 \times 10^8$ | O | O | O |
| EX 1-4 | $3 \times 10^{10}$ | O | O | O |
| CE 1-4 | $2 \times 10^{11}$ | Δ | O | O |
| CE 1-5 | $2 \times 10^{12}$ | Δ | O | O |

EX: experimental example
CE: comparative experimental example
S/R: surface resistivity
U/D: uniformity in discharging
S/Pt: variation width ΔV of potential at photosensitive drum surface
R/Pin: resistance against pin-hole From the above results of experiments, the following can be understood. According to the device, in which the charge contributing surface of the film charging member 21 has the surface resistivity in a range from $1\times10^5$ Ω/□ to $1\times10^{10}$ Ω/□, the scale-like charging irregularity at the photosensitive drum 1 can be suppressed, and variation in charged potential of the photosensitive drum 1 due to environmental variation can also be suppressed. Further, it is possible to suppress damages such as scorch and burn due to scratches such as a pin-hole at the surface of the photosensitive drum 1

In the above experiments, the charging member 21 has the volume resistivity of about $3\times10^5$ Ω·cm. However, similar effect can be achieved if the volume resistivity is in a range from $1\times10^4$ Ω·cm to $1\times10^{10}$ Ω·cm, and more preferably from $1\times10^4$ Ω·cm to $1\times10^6$ Ω·cm.

The foregoing experiments employed the film charging members of the two layer structure. However, the film charging member may have one-layer structure provided that the volume resistivity is in a range from $1\times10^4$ Ω·cm to $1\times10^{10}$ Ω·cm, and the surface resistivity is in a range from $1\times10^5$ Ω/□ to $1\times10^{10}$ Ω/□.

Another example of the contact charging device will be described below.

This contact charging device is similar to the device shown in FIG. 2. The contact charging device also includes the film charging member 21 which is a sheet-like contact member for charging. The film F having predetermined sizes is supported at one end f1 by the supporting member 22 in a cantilever manner. The free end f2 of the film F is bent upward, and the surface 211 at and near the free end opposed to the photosensitive drum 1 is brought into contact with the surface of the photosensitive drum 1. The power source PW applies the DC voltage Vc to the charging member 21.

The film F forming the charging member 21 is likewise a flexible film as disclosed in U.S. Pat. No. 5,192,974. More specifically, the film F has a bending moment Mm of 20 g·cm or less and more preferably of 10 g·cm or less which is required for winding the film having a width b of 1 cm around the core rod R having an outer diameter D of 1 cm. It has a sufficient mechanical strength against breakage, tear and others required for the charging member.

In this charging device, however, the material of the film is selected from materials having predetermined surface hardness in a range which will be described later.

Figure 4:
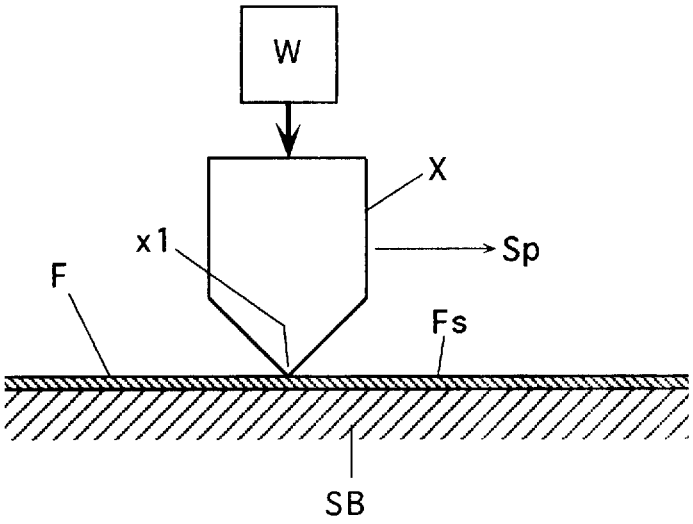
FIG. 4 shows a method of measuring a surface hardness of a film (film charging member)

As shown in FIG. 4, a conical diamond contact needle X is prepared. A tip end x1 of this needle X has an apical radius of 5 μm and an apical angle of 90 degrees. The tip end x1 of this contact needle X is brought perpendicularly into contact with a flat surface Fs of the film F, which is fixed on a sample support table SB in such a manner that the film surface Fs to be opposed to the photosensitive drum 1 has a flat form. With a load W of 0.4 g, the needle X is moved on the surface Fs (i.e., parallel to the surface Fs) at a speed Sp of 0.3 mm/second. The width of the scratch produced thereby is measured. According to the predetermined surface hardness described above, the width of scratch is 1 μm or less. This width is measured by an unillustrated measuring device.

This charging device includes the film charging member 21 having the aforementioned surface hardness. Therefore, minute irregular portions are suppressed from being formed at the surface opposed to the photosensitive drum 1 due to sliding and others with respect to the photosensitive drum 1, and therefore it is possible to suppress local filling and accumulation of foreign matters such as shaved powder of the photosensitive drum, residual toner and paper powder, which may cause charging irregularity in a brush-stroke-like form. Thereby, charging irregularity in a brush-stroke-like form can be suppressed to a practically acceptable extent, and good charging can be stably performed for a long term.

Description will now be given on experimental examples 2-1 to 2-8 which prove that the charging device 2 can sufficiently suppress the brush-stroke-like charging irregularity owing to the fact that the charging member 21 has the aforementioned surface hardness. These experimental examples 2-1 to 2-8 using the charging members formed of the films F made of various kinds of material are shown in the following table 2 together with comparative experimental examples 2-1 to 2-5 which were performed for comparison.

All the experiments were performed with the printer already described. The system speed is the same as that already described, and the voltage Vc applied to the charging member 21 was −1.3 kV. The developing bias voltage $V_B$ was set to −300 v.

Films forming the charging members for experiments had the one-layer structure or two-layer structure as described in "F/S (film structure)" in the following table 2. The one-layer structure employed a film of about 30 μm in thickness, which was made of resin shown in "B/R (film base resin)" in the following table and electrically conductive carbon powder dispersed therein and had an adjusted resistance (volume resistivity in a range from $1\times10^4$ Ω·cm to $1\times10^6$ Ω·cm). The two-layer structure was formed of a film of about 30 μm in thickness made of PET (polyethylene terephthalate) and a photosensitive member contact layer of about 3 μm in thickness formed over the PET film. The photosensitive member contact layer was made of resin shown in "B/R (film base resin)" in the following table and electrically conductive carbon powder dispersed therein and had an adjusted resistance (volume resistivity in a range from $1\times10^4$ Ω·cm to $1\times10^6$ Ω·cm). The film surface hardness was adjusted by selecting the kind of the base resin and a molecular weight of the resin.

When the brush-stroke-like charging irregularity occurs, brush-stroke-like noises appear at the image for evaluating the charged state. Therefore, the charging performance was evaluated by observing the brush-stroke-like noises at the images. Description will be given on a manner of evaluating brush-stroke-like noises appearing at the image based on the brush-stroke-like charging irregularity at the surface of the photosensitive drum 1.

(Evaluation of Brush-Stroke Noises)

Figure 5:
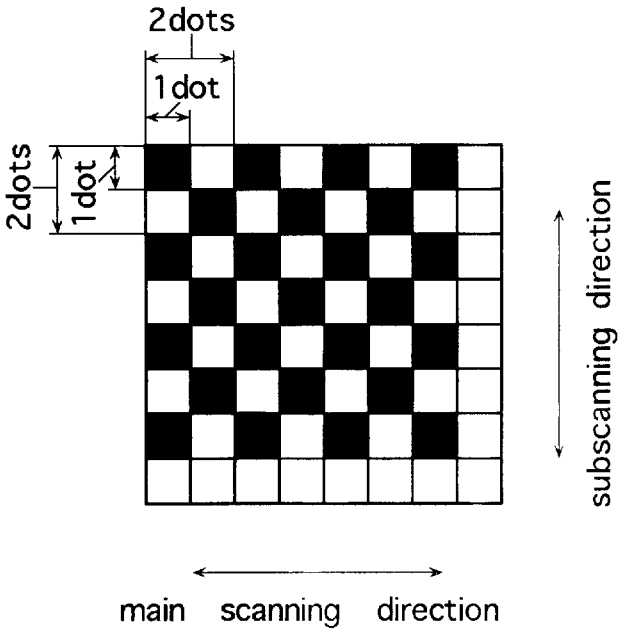
FIG. 5 shows an example of a mesh image.
Figure 6:
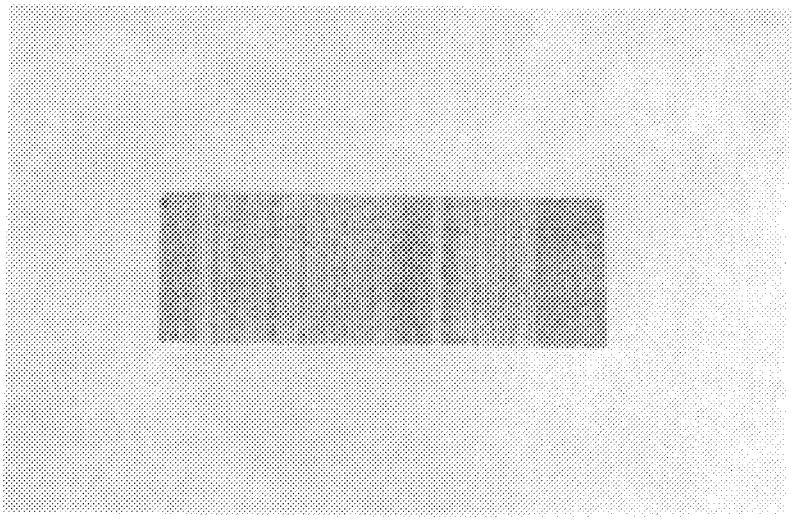
FIG. 6 shows an example of an image bearing scale-like noises.
Figure 7:
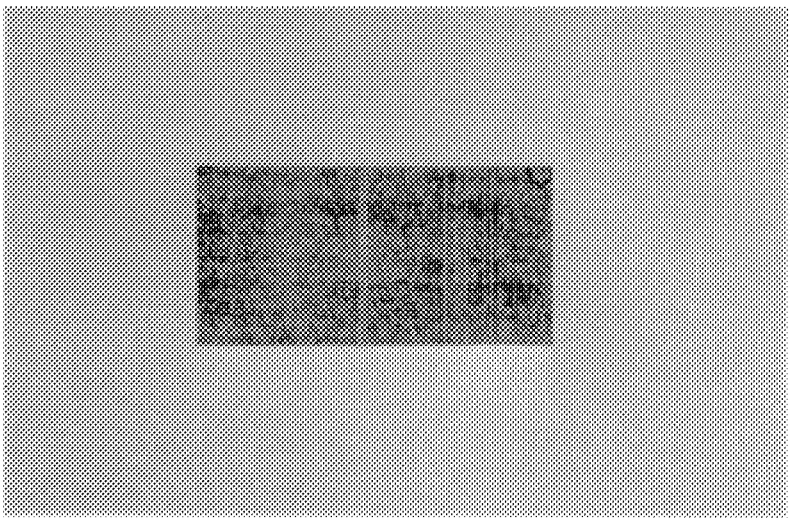
FIG. 7 shows an example of an image bearing brush-stroke-like noises.

As shown in FIG. 5, a mesh-point image of 1-dot/4-dots was printed on 3000 transfer sheets of A4-size. Then, one sheet printed thereafter was measured with Sakura density meter (model PDA-65) manufactured by Konica Co., Ltd. to determine a variation width ΔD of the image density in a lateral direction (widthwise of the sheet). Based on the results, image noises were ranked as follows.

| Variation Width ΔD | Evaluation Rank |
|---|---|
| ΔD < 0.05 | 5 (substantially no problem) |
| 0.05 ≦ ΔD < 0.10 | 4 (substantially no problem) |
| 0.10 ≦ ΔD < 0.15 | 3 (practically acceptable limit) |
| 0.15 ≦ ΔD < 0.20 | 2 (unacceptable level) |
| 0.20 ≦ ΔD | 1 (unacceptable level) |

TABLE 2

| | F/S | B/R | F/H (μm) | Result |
|---|---|---|---|---|
| EX 2-1 | single | polyimide | 0 (n/s) | 5 |
| EX 2-2 | single | polyimide | 1 | 4 |
| EX 2-3 | single | polyimide | 0.5 | 5 |
| EX 2-4 | single | polyethylene | 1 | 4 |
| CE 2-1 | single | polyether ether ketone | 2 | 2 |
| CE 2-2 | single | polyamide | 6 | 2 |
| CE 2-3 | single | FEP | 8.5 | 2 |
| EX 2-5 | double | UV | 1 | 3 |
| EX 2-6 | double | UV | 0.5 | 5 |
| EX 2-7 | double | UV | 0.5 | 5 |
| EX 2-8 | double | T/Si | 1 | 4 |
| CE 2-4 | double | polyester | 8 | 1 |
| CE 2-5 | double | T/Si | 2.5 | 2 |

EX: experimental example
CE: comparative experimental example
F/S: film structure
B/R: film base resin
F/H: film surface hardness
Result: result of evaluation of brush-stroke-like irregularity after printing of 3000 sheets.
single: single layer
double: double layers
(n/s): no scratch
FEP: tetrafluoroethylene hexafluoropropylene copolymer
UV: ultraviolet-curing resin
T/Si: two-fluid-curing Si acrylic From the above results of experiments, it can be understood that the film charging member 21 having the surface hardness providing the scratch width of 1 μm or less can perform good charging by preventing the charging irregularity in the brush-stroke-like form or suppressing the same to a practically acceptable extent for a long term.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device for charging a charge receiving member comprising;

an electrical power source for supplying an electrical power; and a contact member which is electrically connected with said electrical power source, said contact member having a surface for contacting with the charge receiving member, wherein said surface has a volume resistivity in a range from $1\times10^4$ Ω·cm to $1\times10^6$ Ω·cm, and has a surface resistivity in a range from $1\times10^5$ Ω/□ to $1\times10^{10}$ Ω/□, wherein the bending moment of said contact member is 20 g·cm or less.

2. The charging device as claimed in claim 1, wherein said contact member is a sheet-like member.

3. The charging device as claimed in claim 2, further comprising:

a support member which supports said contact member in a cantilever manner.

4. The charging device as claimed in claim 2, wherein the bending moment of said contact member is 20 g·cm or less.

5. The charging device as claimed in claim 4, wherein the bending moment of said contact member is 10 g·cm or less.

6. The charging device as claimed in claim 1, wherein said contact member is made of an organic material in which carbon particles are dispersed.

7. The charging device as claimed in claim 6, wherein said organic material is polyamide resin.

8. The charging device as claimed in claim 6, wherein said contact member includes two layers each of which is made of an organic material in which carbon particles are dispersed.

9. A charging device for charging a charge receiving member comprising:

an electrical power source for supplying an electrical power; and a contact member which is electrically connected with said electrical power source, said contact member having a surface for contacting with the charge receiving member, wherein the width of scratch of said contact member under the scratch hardness test is 1 $\mu$m or less.

10. The charging device as claimed in claim 9, wherein said contact member is a sheet-like member.

11. The charging device as claimed in claim 10, further comprising:

a support member which supports said contact member in a cantilever manner.

12. The charging device as claimed in claim 10, wherein the bending moment of said contact member is 20 g·cm or less.

13. The charging device as claimed in claim 12, wherein the bending moment of said contact member is 10 g·cm or less.

14. The charging device as claimed in claim 9, wherein said contact member has a volume resistivity in a range from $1\times10^4$ Ω·cm to $1\times10^6$ Ω·cm.

15. The charging device as claimed in claim 9, wherein said contact member is made of polyimide resin.

16. A method of charging a charge receiving member comprising the steps of:

providing a contact member having a surface, said surface having a volume resistivity in a range from $1\times10^4$ Ω·cm to $1\times10^6$ Ω·cm, and having a surface resistivity in the range from $1\times10^5$ Ω/□ to $1\times10^{10}$ Ω/□, wherein a bending moment of 20 g·cm or less;

contacting the surface of said contact member with the charge receiving member; and applying an electrical power to said contact member.

17. A method for charging a charge receiving member comprising the steps of:

providing a contact member having a surface, the width of scratch of said surface under the scratch hardness test being 1 $\mu$m or less;

contacting said surface of the contact member with the charge receiving member; and applying an electrical power to said contact member.

* * * * *